US010034073B2

(12) United States Patent
Evans et al.

(10) Patent No.: US 10,034,073 B2
(45) Date of Patent: Jul. 24, 2018

(54) DEVICE HAVING A COMPOSITE ACOUSTIC MEMBRANE

(71) Applicant: Apple Inc., Cupertino, CA (US)

(72) Inventors: Neal Evans, Sunnyvale, CA (US); Jesse A. Lippert, San Jose, CA (US); Nikolas T. Vitt, Sunnyvale, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 15/192,817

(22) Filed: Jun. 24, 2016

(65) Prior Publication Data

US 2017/0041706 A1 Feb. 9, 2017

Related U.S. Application Data

(60) Provisional application No. 62/201,069, filed on Aug. 4, 2015.

(51) Int. Cl.
*H04R 1/00* (2006.01)
*H04R 1/08* (2006.01)

(52) U.S. Cl.
CPC ..... *H04R 1/086* (2013.01); *H04R 2499/11* (2013.01); *H04R 2499/13* (2013.01)

(58) Field of Classification Search
CPC . H04R 1/00; H04R 1/02; H04R 1/086; H04R 1/44; H04R 7/10; H04R 2499/11; H04R 2499/13; H04M 1/03; H04M 1/18
See application file for complete search history.

(56) References Cited

U.S. PATENT DOCUMENTS

| | | | | |
|---|---|---|---|---|
| 3,539,735 | A | 11/1970 | Marchand | |
| 6,512,834 | B1 | 1/2003 | Banter et al. | |
| 2007/0256562 | A1 | 11/2007 | Routkevitch et al. | |
| 2011/0143114 | A1* | 6/2011 | Horie | B32B 5/32 428/219 |
| 2011/0188247 | A1* | 8/2011 | Huang | B01D 39/1692 362/249.02 |
| 2011/0255728 | A1* | 10/2011 | Abe | H04R 1/086 381/355 |
| 2014/0125360 | A1 | 5/2014 | Goodchild et al. | |
| 2015/0304767 | A1* | 10/2015 | Mori | H04M 1/03 381/334 |
| 2016/0021443 | A1* | 1/2016 | Lee | H04R 1/023 381/334 |
| 2016/0207006 | A1* | 7/2016 | Furuyama | H05K 5/0213 |
| 2016/0228826 | A1* | 8/2016 | Furuuchi | H04R 1/023 |

(Continued)

FOREIGN PATENT DOCUMENTS

| | | | |
|---|---|---|---|
| EP | 1 781 065 | A1 | 5/2007 |
| JP | 2003294687 | A1 | 10/2003 |

*Primary Examiner* — Thang Tran
(74) *Attorney, Agent, or Firm* — Womble Bond Dickinson (US) LLP

(57) ABSTRACT

An electronic device having a composite acoustic membrane to inhibit water ingress and to allow sound transmission, is disclosed. Embodiments include an electroacoustic transducer within an encased space of a casing, and a composite acoustic membrane between the electroacoustic transducer and an acoustic port in the casing. The acoustic membrane may include a nonporous region at least partly covering the acoustic port, and a porous region to vent the electroacoustic transducer volume to the encased space and/or to an environment surrounding the casing. Other embodiments are also described and claimed.

24 Claims, 11 Drawing Sheets

DETAIL A

(56) References Cited

U.S. PATENT DOCUMENTS

| | | | | |
|---|---|---|---|---|
| 2016/0249119 | A1* | 8/2016 | Mori | H04R 1/086 |
| 2016/0354997 | A1* | 12/2016 | Huang | B01D 67/0083 |
| 2017/0026742 | A1* | 1/2017 | Karube | H04R 1/44 |

* cited by examiner

A - A

DETAIL A

DETAIL B

DEVICE HAVING A COMPOSITE ACOUSTIC MEMBRANE

This application claims the benefit of U.S. Provisional Patent Application No. 62/201,069, filed Aug. 4, 2015, and this application hereby incorporates herein by reference that provisional patent application in its entirety.

BACKGROUND

Field

Embodiments related to electronic devices having water resistant barriers are disclosed. More particularly, embodiments related to electronic devices having water resistant membranes are disclosed.

Background Information

An electronic device, such as a computer and/or mobile device, may be exposed to water, e.g., rain or water in a swimming pool. Porous membranes are used to protect electronic components within such electronic devices from particle or water ingress. Such membranes may also allow air exchange between an environment surrounding the electronic device and an enclosed volume within the electronic device. Air exchange across the barrier may be important when ambient pressure swings, e.g., from changes in altitude, can impact the function of an electronic device and device components. For example, a pressure difference across the barrier may cause the barrier to stretch and become effectively stiffer, which may impact acoustic transparency in the case of microphone or speaker barriers, and could damage or break the barrier. Thus, in water resistant applications, porous barriers are typically used.

SUMMARY

Porous barriers used to reduce the likelihood of water ingress are typically acoustically inferior to nonporous membranes of equal water resistance due to a required increase in thickness of the porous membrane. That is, a nonporous barrier can withstand higher water pressure than a porous barrier of equal thickness, and thus, a nonporous barrier to prevent water ingress may be thinner than a porous barrier with comparable water resistance, e.g., resistance to 5 bar water pressure. A nonporous barrier, however, may be gas impermeable, requiring another mechanism of air exchange for barometric relief.

An electronic device may benefit from a membrane that inhibits water ingress, allows gas exchange for pressure equalization, e.g., allows venting of air from an electroacoustic transducer on another side of the membrane for barometric relief, and is acoustically transparent. Such a membrane may be considered to be an acoustic membrane because at least a portion of the membrane may be acoustically transparent. For example, the acoustic membrane may include a nonporous region that prevents water ingress and transfers acoustic energy. Furthermore, at least a portion of the membrane may be acoustically opaque. For example, the acoustic membrane may include a porous region that prevents water ingress and provides barometric venting, yet includes a reactive resistance that inhibits the transfer of acoustic energy.

In an embodiment, an electronic device having a composite acoustic membrane performs well acoustically and has good water resistance. The electronic device may include a casing separating an encased space from a surrounding environment, and an electroacoustic transducer, e.g., a microphone, within the encased space. More particularly, the electroacoustic transducer may have an enclosure wall such that a transducer volume is defined between the enclosure wall and an acoustic port in the casing. A composite acoustic membrane may be between the acoustic port and the transducer volume to provide acoustic transmission and/or venting between the surrounding environment and the transducer volume. More particularly, the composite acoustic membrane may include a nonporous region covering the acoustic port, and the nonporous region may be air impermeable and acoustically transparent to transmit sound. Furthermore, the acoustic membrane may include a porous region in fluid communication with the transducer volume, and the porous region may be air permeable (and water impermeable) and acoustically opaque. Accordingly, the composite acoustic membrane may transmit sound toward the electroacoustic transducer, vent air from the transducer volume, and prevent water from entering the transducer volume.

The electronic device may include other features, such as a protective barrier covering the acoustic port to protect the acoustic membrane. For example, the protective barrier may include a mesh between the surrounding environment and the acoustic membrane to protect the membrane from puncture. A spacer may be placed between the protective barrier and the acoustic membrane to form a protective gap between the protective barrier and the acoustic membrane. As such, the protective barrier may flex, e.g., when an object is inserted into the acoustic port, without contacting and damaging the acoustic membrane.

The composite acoustic membrane may be used in the electronic device as described above, and the composite acoustic membrane may be included as a portion of an electroacoustic transducer component. More particularly, the acoustic membrane may be mounted on the enclosure wall of the electroacoustic transducer to form the electroacoustic transducer component, which may be integrated into the electronic device.

In an embodiment, a method of manufacturing the electronic device or the electroacoustic transducer includes densifying a porous membrane to form the acoustic membrane having the porous region and a densified region, e.g., the nonporous region. The acoustic membrane may be mounted on an electroacoustic transducer and/or a casing of an electronic device such that the porous region of the acoustic membrane faces the transducer volume and the nonporous region of the acoustic membrane at least partly covers the acoustic port in the casing. Accordingly, the acoustic membrane may be integrated in the electronic device to transmit sound into the transducer volume and/or vent air from the transducer volume.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

DETAILED DESCRIPTION

Figure 1:
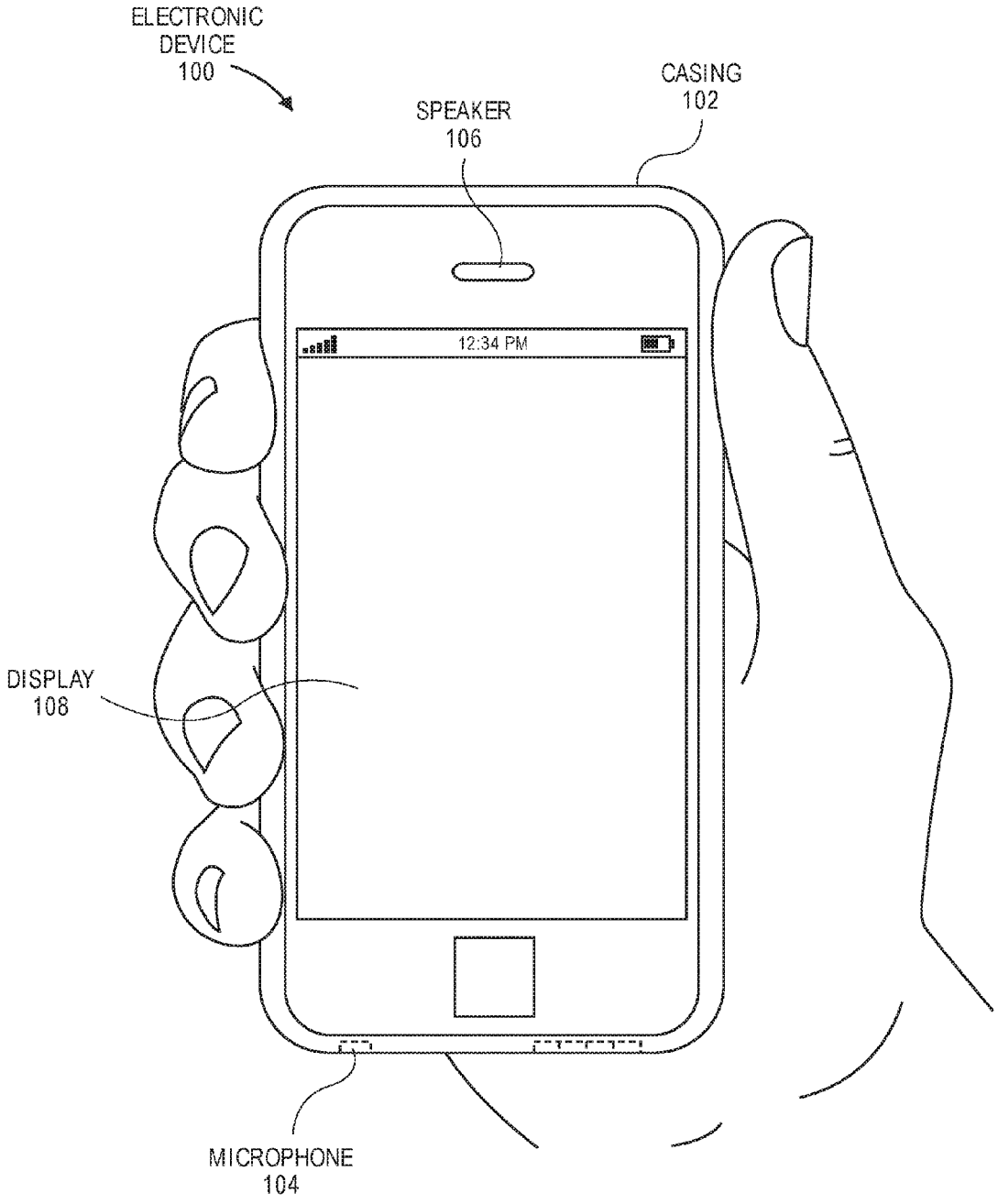
FIG. 1 is a pictorial view of an electronic device in accordance with an embodiment.

Embodiments describe electronic devices and/or electroacoustic transducer components having a composite acoustic membrane that reduces the likelihood of water ingress from a surrounding environment, transfers acoustic energy between the surrounding environment and an electroacoustic transducer, and vents air from an active region of the electroacoustic transducer to the surrounding environment and/or a space within the electronic device. Some embodiments are described with specific regard to integration within mobile devices such as mobile phones. The embodiments are not so limited, however, and certain embodiments may also be applicable to other uses. For example, a composite acoustic membrane may be incorporated into other devices and apparatuses, including desktop computers, laptop computers, tablet computers, wearable computers, wristwatch devices, or motor vehicles, to name only a few possible applications.

In various embodiments, description is made with reference to the figures. Certain embodiments, however, may be practiced without one or more of these specific details, or in combination with other known methods and configurations. In the following description, numerous specific details are set forth, such as specific configurations, dimensions, and processes, in order to provide a thorough understanding of the embodiments. In other instances, well-known processes and manufacturing techniques have not been described in particular detail in order to not unnecessarily obscure the description. Reference throughout this specification to "one embodiment," "an embodiment," or the like, means that a particular feature, structure, configuration, or characteristic described is included in at least one embodiment. Thus, the appearance of the phrase "one embodiment," "an embodiment," or the like, in various places throughout this specification are not necessarily referring to the same embodiment. Furthermore, the particular features, structures, configurations, or characteristics may be combined in any suitable manner in one or more embodiments.

The use of relative terms throughout the description, such as "in front of" and "behind" may denote a relative position or direction. For example, an acoustic membrane may be described as being "behind" a port in a casing when it is on an opposite side of the port from a surrounding environment, i.e., when the surrounding environment is "in front of" of the port. Nonetheless, such terms are not intended to limit the use of an acoustic membrane to a specific configuration described in the various embodiments below. For example, an acoustic membrane may be located on the same side of the port as the surrounding environment.

In an aspect, an electronic device includes a composite acoustic membrane having a porous region and a nonporous region. The porous region may be water resistant and allow air exchange for pressure equalization. The nonporous region may be water resistant and acoustically transparent. Thus, the composite acoustic membrane may inhibit water ingress, vent an acoustically active region of an electronic device, and transmit sound from a surrounding environment to an electroacoustic transducer component within the electronic device.

Referring to FIG. 1, a pictorial view of an electronic device is shown in accordance with an embodiment. An electronic device 100 may be a smartphone device. Alternatively, it could be any other portable or stationary device or apparatus, such as a laptop computer, a tablet computer, a wearable computer, a wristwatch device, etc. Electronic device 100 may include various capabilities to allow the user to access features involving, for example, calls, voicemail, music, e-mail, internet browsing, scheduling, or photos. Electronic device 100 may also include hardware to facilitate such capabilities. For example, a casing 102 may contain a microphone 104 to pick up the voice of a user during a call, and an audio speaker 106, e.g., a micro speaker, to deliver a far-end voice to the near-end user during the call. Speaker 106 may also emit sounds associated with music files played by a music player application running on electronic device 100. A display 108 may present the user with a graphical user interface to allow the user to interact with electronic device 100 and/or applications running on electronic device 100. Other conventional features are not shown but may of course be included in electronic device 100.

Figure 2:
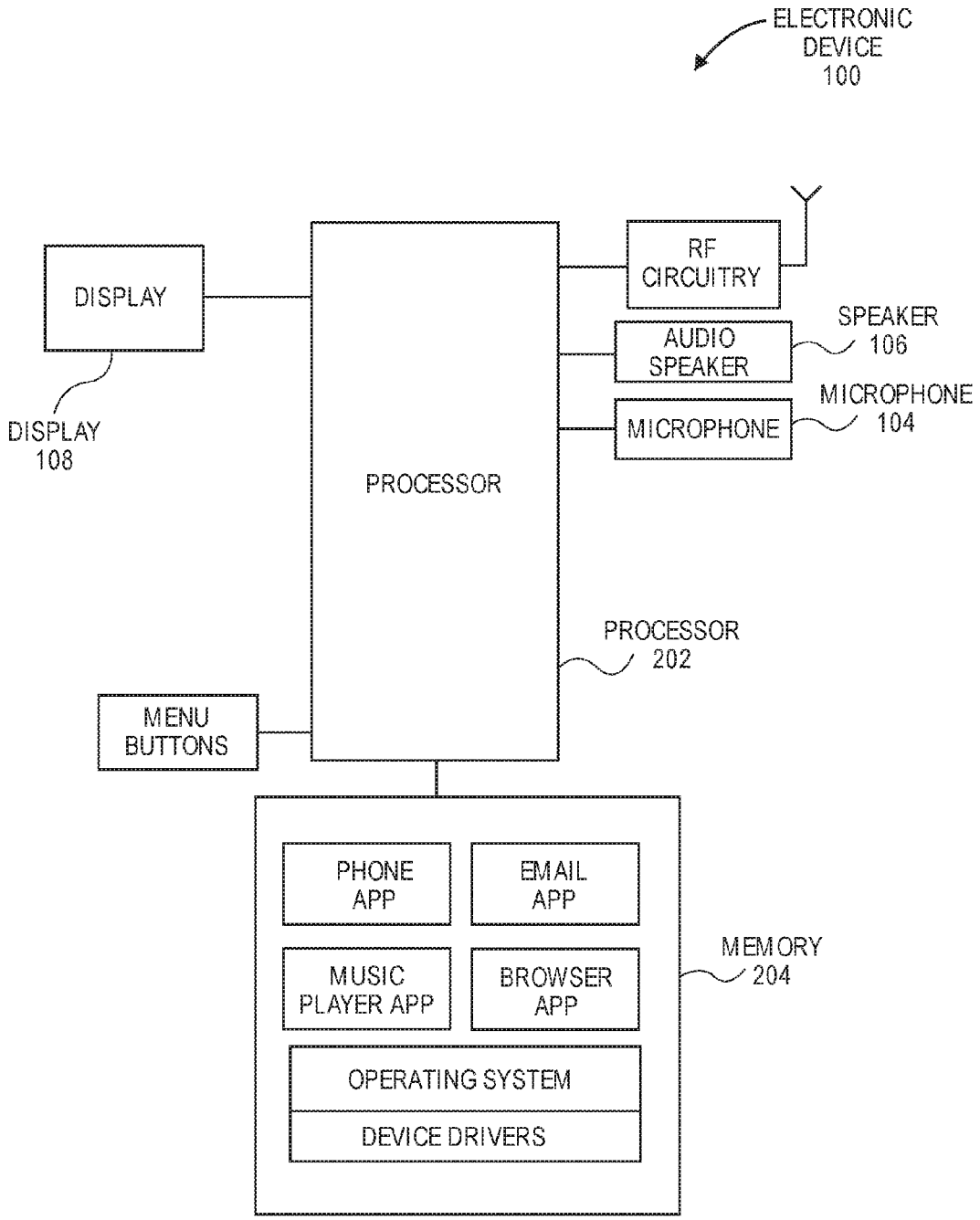
FIG. 2 is a schematic view of an electronic device in accordance with an embodiment.

Referring to FIG. 2, a schematic view of an electronic device is shown in accordance with an embodiment. As described above, electronic device 100 may be one of several types of portable or stationary devices or apparatuses with circuitry suited to specific functionality. Accordingly, the diagrammed circuitry is provided by way of example and not limitation. Electronic device 100 may include one or more processors 202 to execute instructions to carry out the different functions and capabilities described above. Instructions executed by processor(s) 202 of electronic device 100 may be retrieved from a local memory 204, and may be in the form of an operating system program having device drivers, as well as one or more application programs that run on top of the operating system. The instructions may cause electronic device 100 to perform the different functions introduced above, e.g., phone and/or music play back functions. To perform such functions, processor(s) 202 may directly or indirectly implement control loops and receive input signals from and/or provide output signals to other electronic components, such as microphone 104 or speaker 106.

Figure 3A:
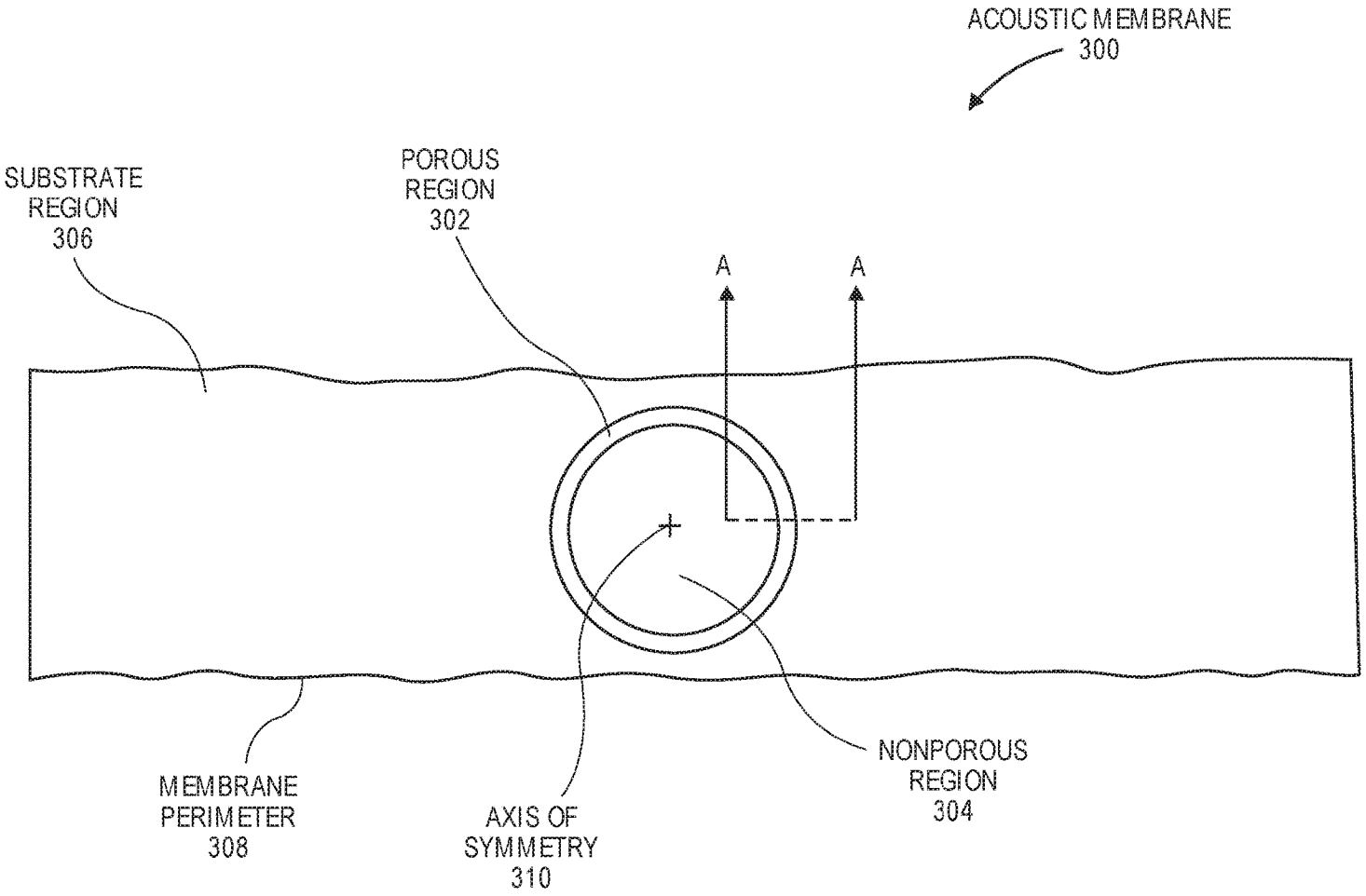
FIG. 3A is a front view of a composite acoustic membrane in accordance with an embodiment.

Referring to FIG. 3A, a front view of a composite acoustic membrane is shown in accordance with an embodiment. That is, the front view may be of a front surface of a composite acoustic membrane 300. In an embodiment, acoustic membrane 300 may be incorporated in electronic device 100 as a water resistant barrier between microphone 104 and/or speaker 106 and an environment surrounding electronic device 100. Acoustic membrane 300 may include several distinct regions. For example, acoustic membrane 300 may include a porous region 302, a nonporous region 304, and optionally, a substrate region 306. Acoustic membrane 300 and the various regions of acoustic membrane 300 may have different shapes in various embodiments.

In an embodiment, acoustic membrane 300 includes a membrane perimeter 308 surrounding the regions of the membrane. The membrane perimeter 308 may be rectangular, or any other shape, e.g., circular, polygonal, etc. Nonporous region 304 may be centrally located relative to membrane perimeter 308. For example, nonporous region 304 may be disposed along an axis of symmetry 310 orthogonal to the front surface of acoustic membrane 300 (coming out of the page in FIG. 3A). In an embodiment, porous region 302 is symmetrically arranged about axis of symmetry 310. Furthermore, nonporous region 304 may include a shape defined by an inner edge of porous region 302. For example, porous region 302 may have an annular shape, and thus, may include an inner circular perimeter and an outer circular perimeter separated by an annulus width. The inner circular perimeter may surround nonporous region 304 such that nonporous region 304 has a circular area. The annular porous region 302 may be centered on axis 310, and thus, the circular area may be centered on axis 310.

Substrate region 306 may be disposed outside of an outer edge of porous region 302. For example, when porous region 302 includes an outer circular perimeter, substrate region 306 may be defined as the portion of acoustic membrane 300 between the outer circular perimeter and membrane perimeter 308. Substrate region 306 may be nonporous, and thus, may be a portion of nonporous region 304. Accordingly, nonporous region 304 may surround porous region 302. Substrate region 306 and nonporous region 304 may have a same or different porosity, and may both be air impermeable. In an embodiment, however, substrate region 306 may be acoustically opaque and nonporous region 304 may be acoustically transparent, or vice versa.

Figure 3B:
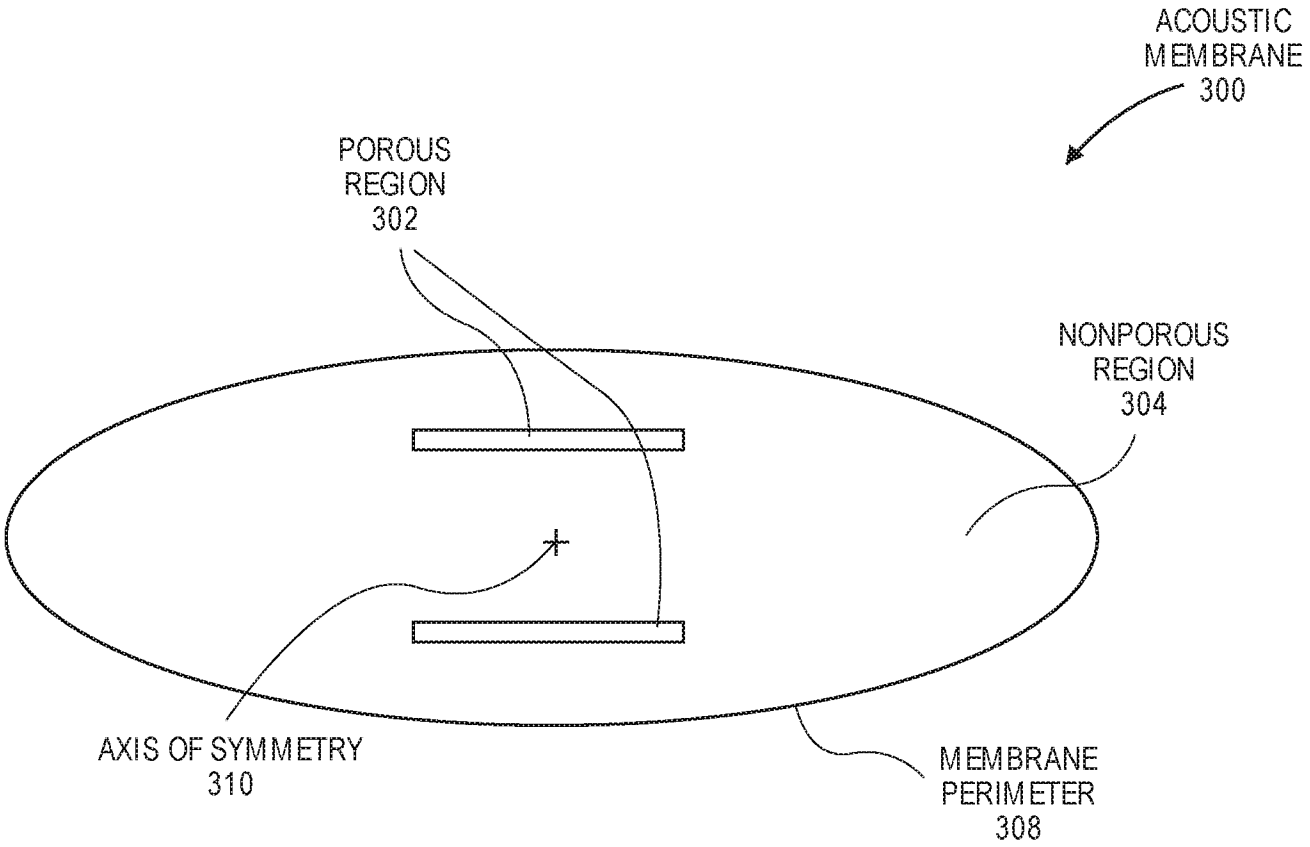
FIG. 3B is a front view of a composite acoustic membrane in accordance with an embodiment.

Referring to FIG. 3B, a front view of a composite acoustic membrane is shown in accordance with an embodiment. In an embodiment, porous region 302 may not surround nonporous region 304. For example, nonporous region 304 may be defined as any region within membrane perimeter 308 that is not occupied by porous region 302. More particularly, acoustic membrane 300 may include nonporous region 304 extending across the membrane area between opposite sides of membrane perimeter 308, and nonporous region 304 may surround one or more porous regions 302. Here, the term "surround" is used to describe nonporous region 304 extending around sidewalls of porous region 302 within a plane parallel to the front surface of acoustic membrane 300. That is, nonporous region 304 and porous region 302 may have exposed (uncovered) front and back surfaces. Accordingly, an outer edge of nonporous region 304 may coincide with membrane perimeter 308. Furthermore, porous region 302 may include several noncontiguous segments, such as two straight bars offset on opposite sides of the axis of symmetry 310 of acoustic membrane 300. The bars may be symmetric about, e.g., mirrored relative to, axis of symmetry 310. Porous region 302 and/or segments of porous region 302 may be shaped in any manner, including as arc segments, as angular segments, or as any other shape that is surrounded by nonporous region 304. In an embodiment, nonporous region 304 is intersected by the axis of symmetry 310.

In an embodiment, a surface area of porous region 302 may be less than a surface area of nonporous region 304. For example, nonporous region 304 may include a surface area that is at least 10% greater, e.g., more than 50% greater, than a surface area of porous region 302. Furthermore, nonporous region 304 may occupy a proportionally larger percentage of a total surface area of acoustic membrane 300, as compared to porous region 302. For example, porous region 302 may occupy not more than 25% of the total surface area, and nonporous region 304 may occupy more than 25% of the total surface area.

Figure 4:
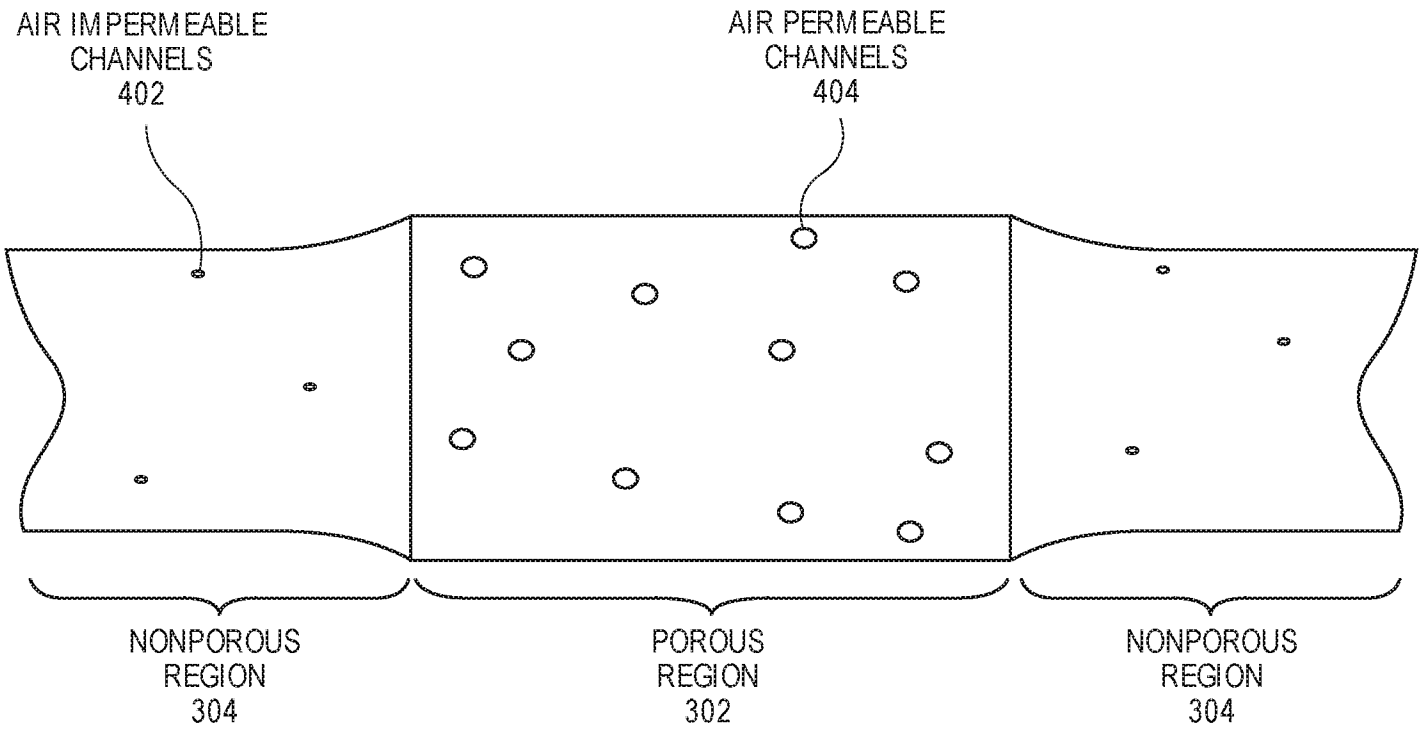
FIG. 4 is a sectional view, taken about line A-A of FIG. 3A, of a composite acoustic membrane in accordance with an embodiment.

Referring to FIG. 4, a sectional view, taken about line A-A of FIG. 3, of a composite acoustic membrane is shown in accordance with an embodiment. In an embodiment, porous region 302 is air permeable. That is, porous region 302 may include air permeable channels 404 to allow air to pass from one side of acoustic membrane 300 to another side of acoustic membrane 300. For example, air permeable channels 404 may have a mean cross-sectional dimension greater than the mean free path of air at ambient pressure, e.g., greater than 70 nm. Thus, air permeable channels 404 may pass air across acoustic membrane 300. This air transfer may provide gas exchange across acoustic membrane 300 to provide pressure equalization between regions on opposite sides of acoustic membrane 300. By contrast, nonporous region 304 of acoustic membrane 300 may be air impermeable. That is, nonporous region 304 may include air impermeable channels 402. Air impermeable channels 402 may have a mean cross-sectional dimension less than the mean free path of air at ambient pressure, e.g., less than 50 nm. Thus, air impermeable channels 402 may inhibit the passage of air across acoustic membrane 300, and reduce the likelihood of gas exchange between regions located on opposite sides of acoustic membrane 300.

In an embodiment, nonporous region 304 may be acoustically transparent and porous region 302 may be acoustically opaque. More particularly, nonporous regions 304 may include a reactive resistance below a predetermined acoustic transparency threshold and porous region 302 may include a reactive resistance above a predetermined acoustic opacity threshold. For example, the acoustic transparency threshold may refer to nonporous region 304 having an acoustic loss of less than 6 decibel when impacted by longitudinal sound waves, e.g., an acoustic loss of less than 1 decibel. By contrast, the acoustic opacity threshold may refer to porous region 302 having an acoustic loss of more than 6 decibel when impacted by longitudinal sound waves, e.g., an acoustic loss of more than 10 decibel. Accordingly, nonporous region 304 may deflect sufficiently under the pressure of the longitudinal sound waves to compress air and direct sound to an active region of an electroacoustic transducer 506, and nonporous region 304 may not deflect sufficiently under the pressure to transmit such sound.

The relative acoustic transparency and/or opacity of the different regions of a composite acoustic membrane 300 may depend on the thickness and density of the regions. For example, as described below, porous region 302 and nonporous region 304 may begin as a same bulk substrate material, e.g., a porous substrate, and a portion of the bulk substrate material may be densified to form nonporous region 304. Thus, respective cross-sections taken axially through nonporous region 304 and porous region 302 may have a same mass, but nonporous region 304 may be denser then porous region 302. Accordingly, porous region 302 may have a greater volume than nonporous regions 304, and portions of acoustic membrane 300 having air permeable channels 404 may be thicker than portions of acoustic membrane 300 having air impermeable channels 402. In an embodiment, the thicker porous regions 302 may have higher reactive resistance, causing the porous regions 302 to be acoustically opaque. By contrast, the thinner nonporous regions 304 may have lower reactive resistance, causing the nonporous regions 304 to be acoustically transparent.

Figure 5:
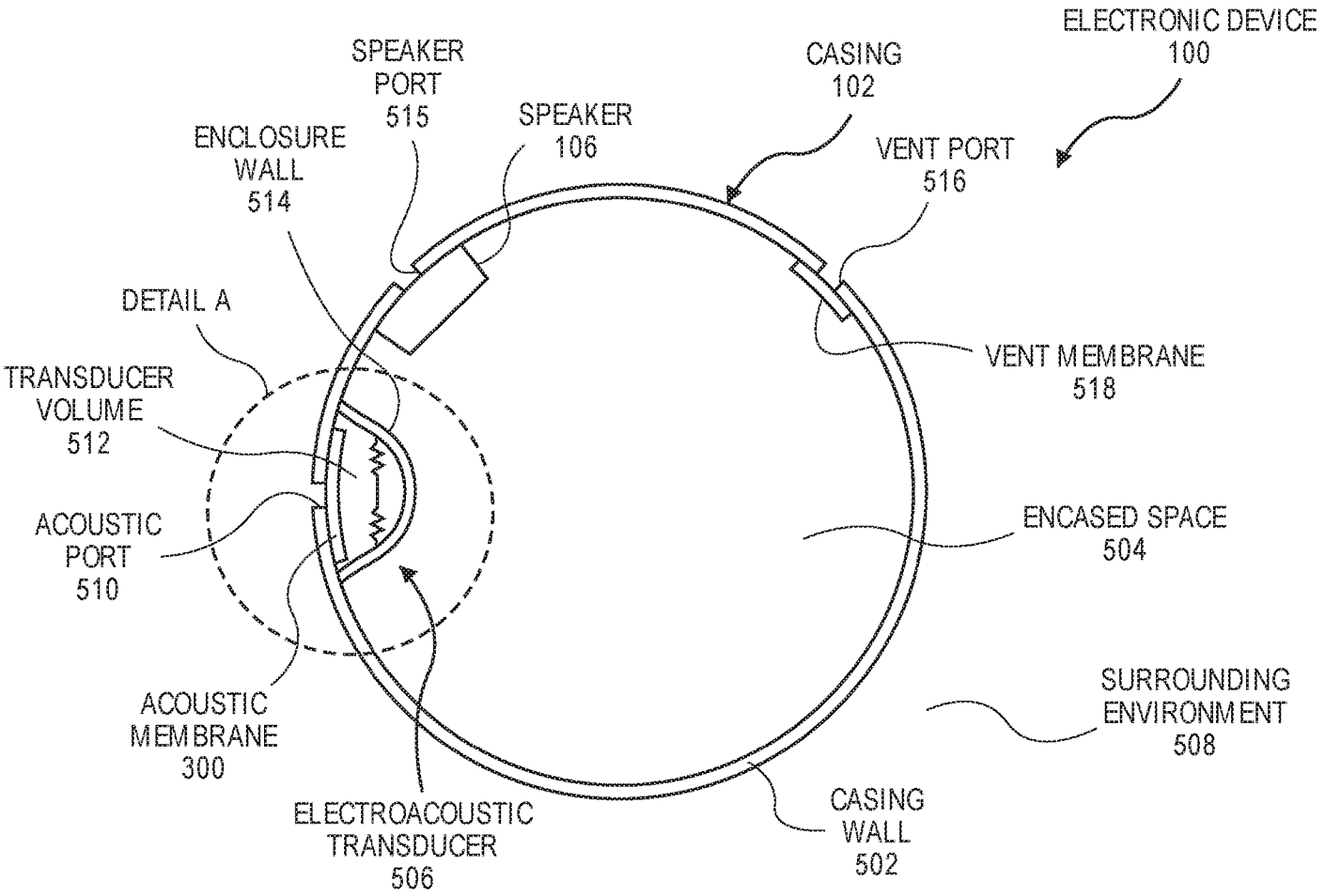
FIG. 5 is a sectional view of an electronic device having a composite acoustic membrane in accordance with an embodiment.

Referring to FIG. 5, a sectional view of an electronic device having a composite acoustic membrane is shown in accordance with an embodiment. Casing 102 may include a casing wall 502 having an outer surface defining exterior contours of electronic device 100 and an inner surface enclosing an encased space 504 of electronic device 100. One or more electronic components may be housed within encased space 504. For example, electronic device 100 may include an electroacoustic transducer component 506, e.g., microphone 104, connected to the inner surface of casing 102 at a first location within encased space 504. Speaker 106 may be located at a second location within encased space 504. Speaker 106 is shown generically in FIG. 5, but it will be appreciated that the speaker 106 may be one of different types of speakers, e.g., the speaker 106 may include an open or closed-back speaker. Casing 102 may surround the encased components of electronic device 100 and separate the electronic components from a surrounding environment 508. Furthermore, casing 102 may enclose other components of electronic device 100, e.g., electronic circuitry associated with the various components described above with respect to FIG. 2.

Casing 102 may separate encased space 504 from surrounding environment 508, however, one or more openings may be disposed in the casing wall 502 to place the encased space 504 in fluid communication with the surrounding environment 508. More particularly, apertures may be located between surrounding environment 508 and one or more portions of encased space 504. For example, an acoustic port 510 may be disposed in casing 102 between surrounding environment 508 and a transducer volume 512, i.e., an active volume of an electroacoustic transducer 506. Transducer volume 512 may be a portion, i.e., a sub-volume, of encased space 504. More particularly, transducer volume 512 may be the space between an enclosure wall 514 of electroacoustic transducer 506, e.g., microphone 104, and the inner surface of casing 102. More particularly, transducer volume 512 may be between enclosure wall 514 and acoustic port 510.

In an embodiment, one or more of the openings may be covered by a barrier having water resistance characteristics and acoustic characteristics. For example, acoustic membrane 300 may cover acoustic port 510. As described above, acoustic membrane 300 may be a composite acoustic membrane having porous region 302 and nonporous region 304. Accordingly, porous region 302 and nonporous region 304 of acoustic membrane 300 may provide water resistant characteristics to acoustic port 510, and nonporous region 304 of acoustic membrane 300 may provide acoustic characteristics to acoustic port 510. Here, acoustic characteristics refers to the acoustic transparency of nonporous regions 304. More particularly, longitudinal sound waves that impact the nonporous regions 304 may deflect acoustic membrane 300 sufficiently to compress air and transmit sound to an active region of an electroacoustic transducer 506, e.g., microphone 104 or an electrodynamic speaker 106, located behind acoustic port 510.

Some ports in casing 102 may be uncovered. More particularly, some ports may provide open channels, i.e., non-acoustically resistant channels, between surrounding environment 508 and encased space 504 or a component located within encased space 504. For example, speaker 106 may be located within encased space 504 behind a speaker port 515. Speaker port 515 may be uncovered, and thus, may provide a water ingress point between surrounding environment 508 and a portion of speaker 106 that is located behind speaker port 515. The exposed portion of speaker 106, however, may have a water resistant construction and/or may include a water resistant component, e.g., a sealed speaker diaphragm that is in direct contact with the incoming water. Thus, water ingress into encased space 504 may be inhibited. In an embodiment, speaker port 515 may be covered by a membrane, e.g., acoustic membrane 300, to provide water resistance and transmit sound toward surrounding environment 508.

One or more ports in casing 102 may be covered by a membrane having only water resistant characteristics or only acoustic characteristics. For example, a vent port 516 may be disposed in casing 102 between surrounding environment 508 and encased space 504. Vent port 516 may function, for example, to equalize pressure between encased space 504 and surrounding environment 508. That is, vent port 516 may provide a barometric vent between encased space 504 and surrounding environment 508. Some components of electronic device 100, such as microphone 104 or speaker 106, may affect the air pressure within encased space 504. Vent port 516 in casing 102 may accommodate such pressure fluctuations, and maintain pressure equilibrium between encased space 504 and surrounding environment 508. A vent membrane 518 may cover vent port 516 to provide a barrier against water ingress through vent port 516. Thus, vent membrane 518 may be formed to include material properties, e.g., porosity, similar to porous region 302 of acoustic membrane 300 such that vent membrane 518 exhibits water resistant and gas exchange characteristics, but not acoustic characteristics.

Figure 6:
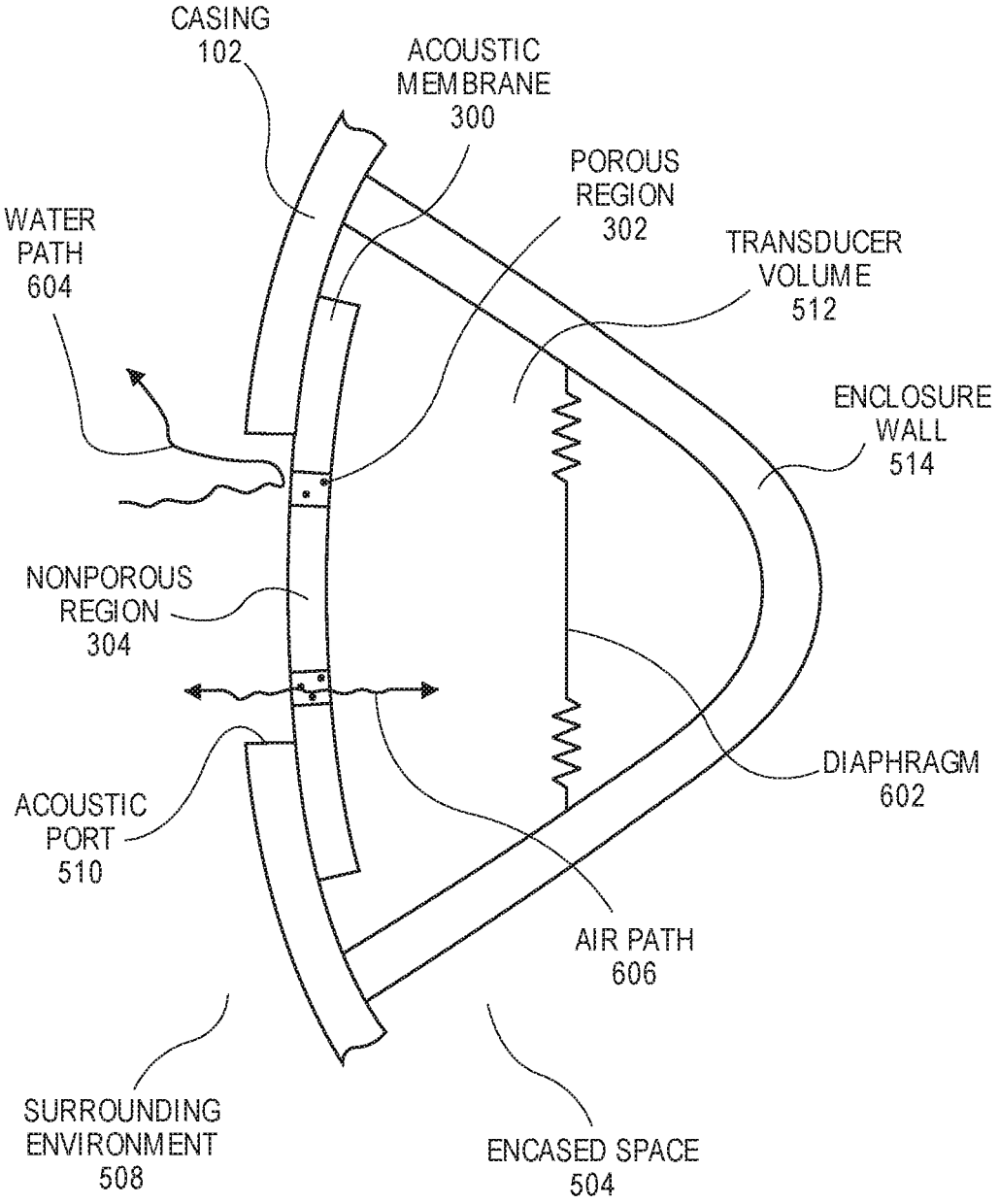
FIG. 6 is a detailed sectional view, taken from Detail A of FIG. 5, of an electronic device having a composite acoustic membrane in accordance with an embodiment.

Referring to FIG. 6, a detailed sectional view, taken from Detail A of FIG. 5, of an electronic device having a composite acoustic membrane is shown in accordance with an embodiment. Microphone 104 may be mounted on the inner surface of casing 102. For example, enclosure wall 514 may be attached to the inner surface by a pressure sensitive adhesive bond, or another manner of attachment. Thus, transducer volume 512 may be separated from encased space 504 by enclosure wall 514. Sub-components of microphone 104, such as a diaphragm 602, may be disposed within transducer volume 512. The functionality of microphone 104, e.g., the sensitivity of diaphragm 602 to external sounds, may be enhanced by isolating transducer volume 512 from water outside of microphone 104 and by facilitating barometric relief of pressure generated within transducer volume 512.

In an embodiment, acoustic port 510 is covered by acoustic membrane 300 having regions that selectively repel water while allowing air to be freely exchanged between surrounding environment 508 and transducer volume 512. More particularly, a portion of acoustic membrane 300 facing acoustic port 510, i.e., covering acoustic port 510, may have a porosity that does not allow water ingress. For example, porous region 302 and nonporous region 304 of acoustic membrane 300 exposed to the opening of acoustic port 510 may form a barrier against water such that water traveling along a water path 604 toward acoustic membrane 300 is repelled outward and away from transducer volume 512. By contrast, porous region 302 of acoustic membrane 300 may have a porosity that allows air to travel across a thickness of acoustic membrane 300, and thus, air may move freely along an air path 606 between surrounding environment 508 and transducer volume 512. That is, porous region 302 may vent air within transducer volume 512 to surrounding environment 508. Porous region 302 may thus be considered to be in fluid communication with transducer volume 512 because a gas, e.g., air, can pass through porous region 302 to or from transducer volume 512, even though a liquid, e.g., water, may not. Accordingly, microphone 104 components within transducer volume 512 may be protected against water ingress and air pressure within transducer volume 512 may be equalized with the air pressure outside of casing 102 to facilitate microphone sensitivity.

A total surface area of porous regions 302 exposed to acoustic port 510 may be comparatively smaller than a total surface area of nonporous regions 304 exposed to acoustic port 510. For example, the total surface area of the porous region 302 may be less than 20%, e.g., less than 10%, of the total surface area of nonporous region 304 exposed to acoustic port 510. Accordingly, the area of acoustic membrane 300 exposed to longitudinal sound waves coming from surrounding environment 508 may be mostly acoustically transparent, allowing for effective transfer of sound to an active region of microphone 104 located behind acoustic port 510.

Figure 7:
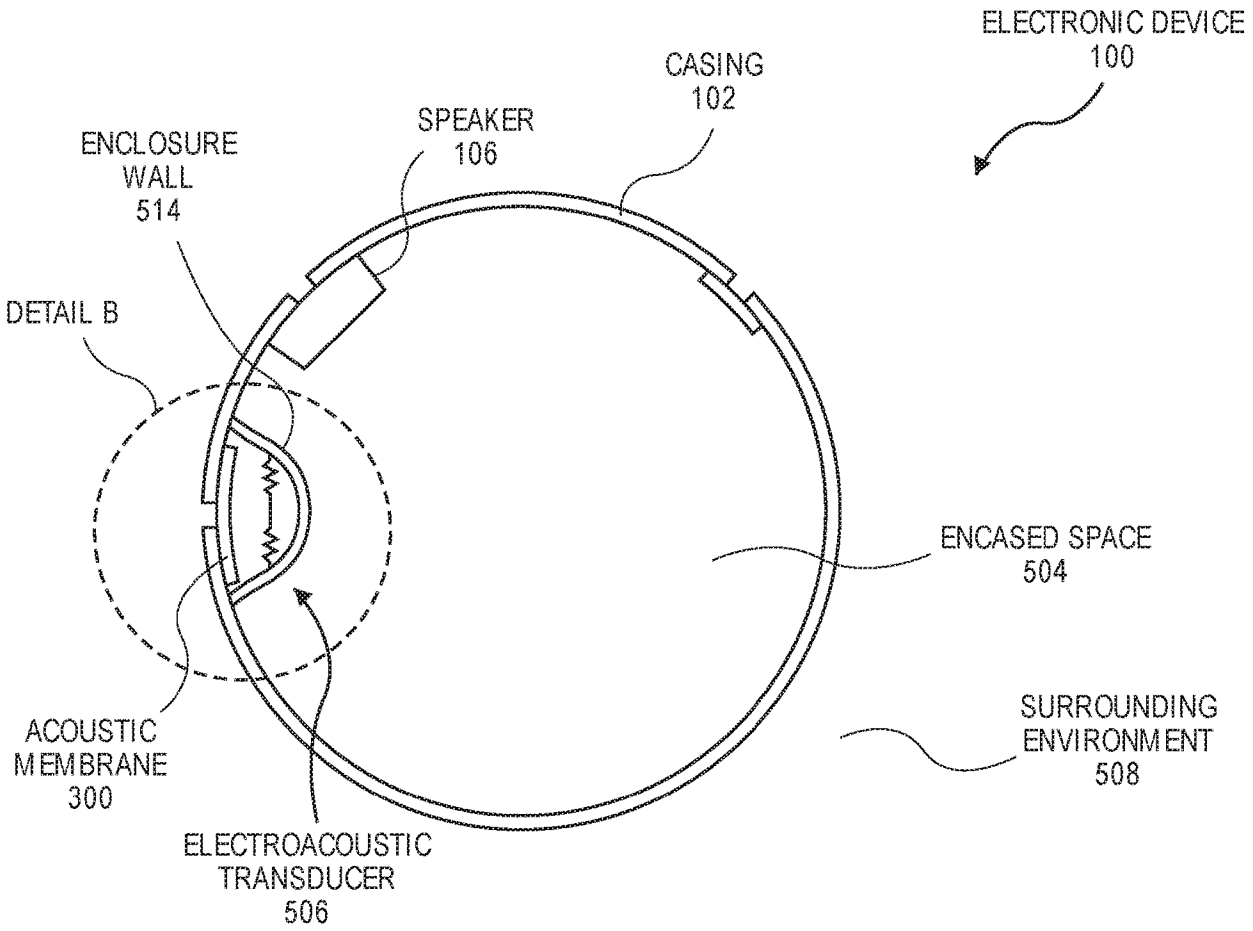
FIG. 7 is a sectional view of an electronic device having a composite acoustic membrane in accordance with an embodiment.

Referring to FIG. 7, a sectional view of an electronic device having a composite acoustic membrane is shown in accordance with an embodiment. Electronic device 100 may have a similar structure to that shown in FIG. 5. For example, casing 102 may surround several electronic components including an electroacoustic transducer, e.g., microphone 104, and speaker 106, and those components may be located within encased space 504 relative to one or more ports. Furthermore, the ports may be covered by membranes having water resistant and/or acoustic characteristics. Thus, the electronic components may be protected against water ingress from surrounding environment 508. In an embodiment, acoustic membrane may be a composite acoustic membrane 300 having water resistant characteristics and having a structure and arrangement that allows pressure generated within microphone 104 to equalize with pressure in encased space 504.

Figure 8:
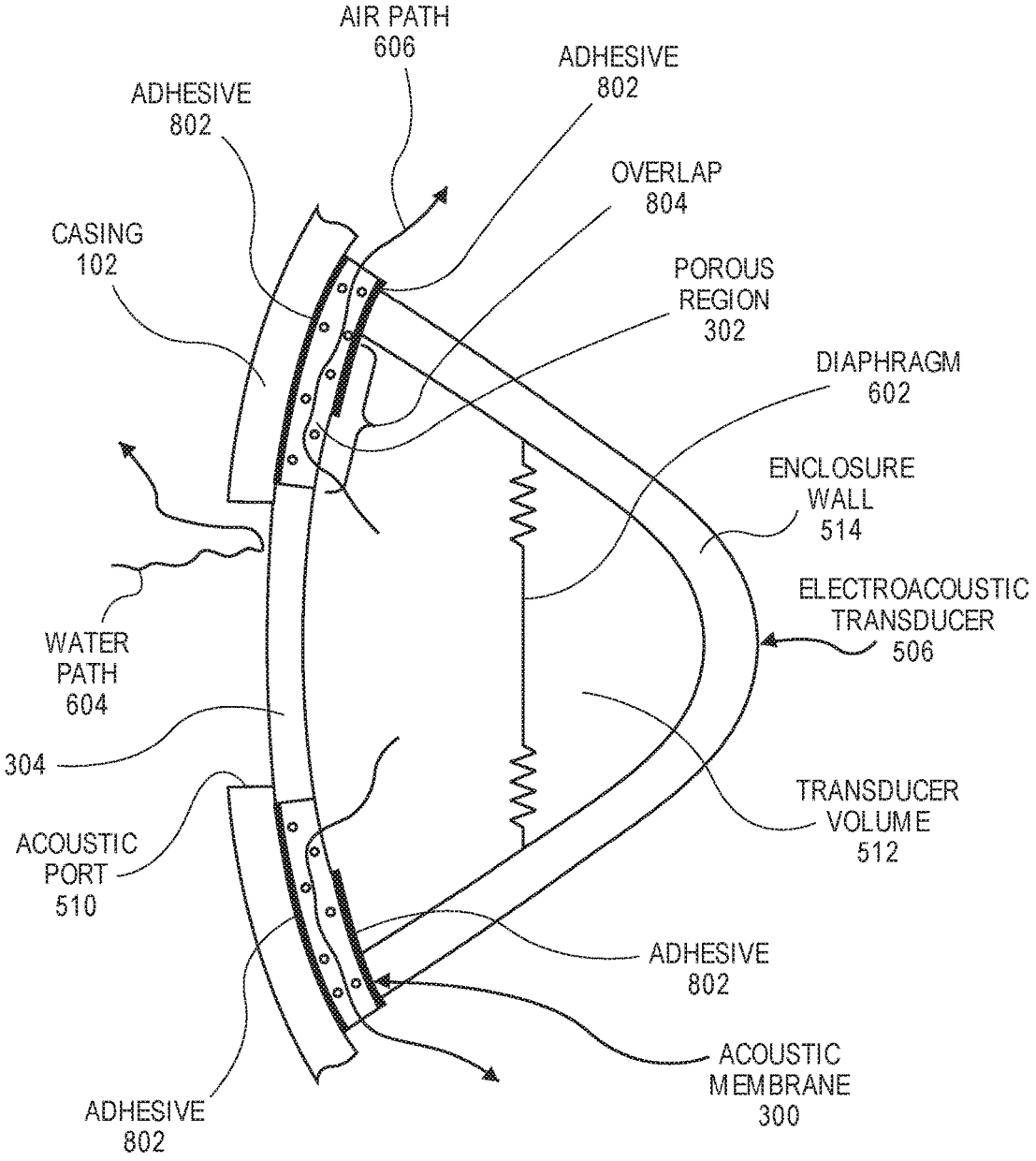
FIG. 8 is a detailed sectional view, taken from Detail B of FIG. 7, of an electronic device having a composite acoustic membrane in accordance with an embodiment.

Referring to FIG. 8, a detailed sectional view, taken from Detail B of FIG. 7, of an electronic device having a composite acoustic membrane is shown in accordance with an embodiment. Casing 102 may include acoustic port 510 vulnerable to the ingress of water as described above. To prevent such ingress, acoustic membrane 300 may be used to cover acoustic port 510. In an embodiment, an electroacoustic transducer component 506 is attached to the inner surface of casing 102 to provide such covering. For example, the electroacoustic transducer component 506 may include the subcomponents of microphone 104, e.g., enclosure wall 514, diaphragm 602, etc. Transducer volume 512 of microphone 104 may be disposed between enclosure wall 514 and acoustic membrane 300. More particularly, enclosure wall 514 may be attached to acoustic membrane 300. For example, enclosure wall 514 and/or acoustic membrane 300 may include an adhesive 802, such as a pressure sensitive adhesive (PSA) that bonds and seals the components together. Similarly, acoustic membrane 300 may be attached to the inner wall of casing 102 by an adhesive joint. For example, a PSA may cover a portion of acoustic membrane 300 facing the inner wall such that the electroacoustic transducer 506 component may be pressed against casing 102 to assemble the components.

Acoustic membrane 300 of the electroacoustic transducer 506 component may be positioned between acoustic port 510 and transducer volume 512 such that nonporous region 304 of acoustic membrane 300 at least partly covers acoustic port 510. That is, acoustic membrane 300 may be positioned relative to acoustic port 510 such that nonporous region 304 covers all or most of acoustic port 510. For example, nonporous region 304 may have a dimension across the face of acoustic membrane 300 that is greater than a cross-sectional dimension of acoustic port 510. Accordingly, porous region 302 may be entirely behind casing 102. Furthermore, an adhesive seal may be formed between casing 102 and the front surface of acoustic membrane 300 such that the adhesive seal covers the front surface of porous region 302. Thus, water moving through acoustic port 510 toward transducer volume 512 may only contact nonporous region 304 of acoustic membrane 300, i.e., water may be blocked from porous region 302 by adhesive seal. Thus, water path 604 may be directed away from transducer volume 512 to prevent water ingress into transducer volume 512 and encased space 504.

Acoustic membrane 300 of the electroacoustic transducer 506 component may also be positioned relative to acoustic port 510 such that porous regions 302 of acoustic membrane 300 provide air path 606 between transducer volume 512 and encased space 504 on a back side of enclosure wall 514. For example, a rear surface of acoustic membrane 300 may include porous region 302 facing transducer volume 512 radially inward of enclosure wall 514. The portion of porous region 302 facing transducer volume 512, e.g., the distance between nonporous region 304 and the enclosure wall 514, may be referred to as an overlap region 804. One skilled in the art will appreciate that when speaker 106 is located in encased space 504, pressure variations generated during sound reproduction by speaker 106 may propagate through the acoustic path of porous region 302 into transducer volume 512. Thus, air passage through porous region 302 may be affected, which could impact the microphone response. Accordingly, overlap 804 may be sized to allow air to pass from transducer volume 512 to encased space 504, however, air passage from encased space 504 to transducer volume 512 may be limited. As an example, overlap 804 may have a distance between enclosure wall 514 (or a radially inward edge of adhesive 802 that seals the rear surface of porous region 302) and nonporous region 304 that is less than 0.5 mm.

Furthermore, porous region 302 may face encased space 504, e.g., along an outer edge of acoustic membrane 300 or along the rear surface of acoustic membrane 300 that faces encased space 504 radially outward of enclosure wall 514. Accordingly, air path 606 may be directed through the interconnected air permeable channels 404 of porous region 302 from transducer volume 512 to encased space 504. Thus, air pressure within transducer volume 512 may be equalized with air pressure within encased space 504.

Figure 9:
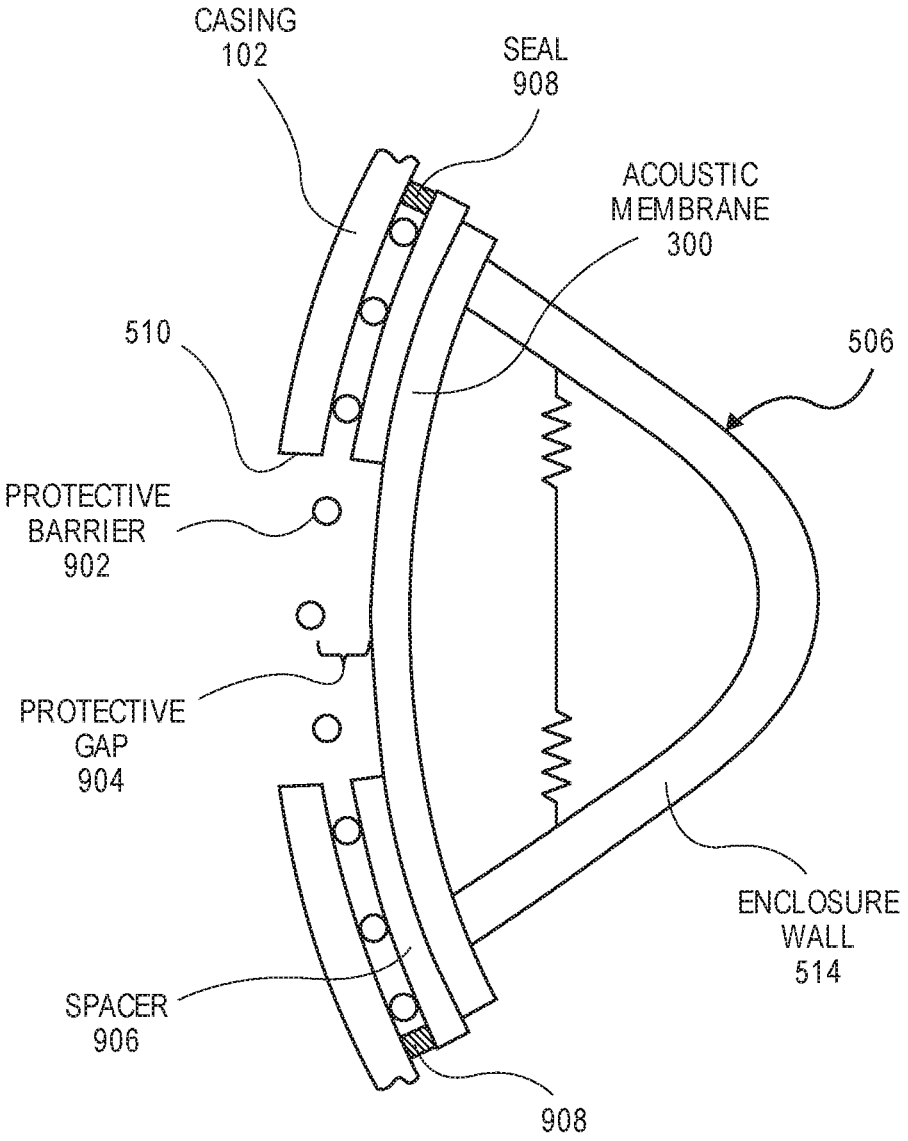
FIG. 9 is a sectional view of an electronic device having a composite acoustic membrane in accordance with an embodiment.

Referring to FIG. 9, a sectional view of an electronic device having a composite acoustic membrane is shown in accordance with an embodiment. In an embodiment, electronic device 100 may include a protective barrier 902 to prevent puncturing of acoustic membrane 300. For example, ingress of debris and/or inadvertent insertion of objects into acoustic port 510 may puncture acoustic membrane 300 and damage the electroacoustic transducer 506. Protective barrier 902 may cover acoustic port 510 and may be located between surrounding environment 508 and acoustic membrane 300. Accordingly, the electroacoustic transducer component having acoustic membrane 300 and the electroacoustic transducer 506, e.g., microphone 104, may be positioned behind protective barrier 902. Protective barrier 902 may include a material with puncture resistance that can block debris ingress. For example, protective barrier 902 may include a woven acoustic mesh, e.g., a metallic mesh having a predetermined porosity and rigidity. Protective barrier 902 may block debris or objects of a predetermined minimum diameter, e.g., the diameter of a wire forming a paper clip.

Protective barrier 902 may flex when pressed, and thus, a protective gap 904 between protective barrier 902 and acoustic membrane 300 may be used to prevent contact between those components. For example, a spacer 906 may be disposed between protective barrier 902 and acoustic membrane 300. Spacer 906 may have a predetermined thickness such that when protective barrier 902 is pressed with a given force, the deflection of protective barrier 902 is less than protective gap 904 created by spacer 906. Accordingly, acoustic membrane 300 is physically protected against piercing by protective barrier 902 and spacer 906. As described above, the components of electronic device 100 may be attached to one another by adhesive bonds, and furthermore, the adhesive bonds may create seals that prevent water and air ingress between the components. Other seals may also be provided. For example, a seal 908 may be formed between spacer 906 and protective barrier 902 outward of the protective mesh such that water ingress into encased space 504 and air egress out of encased space 504 is limited.

Figure 10:
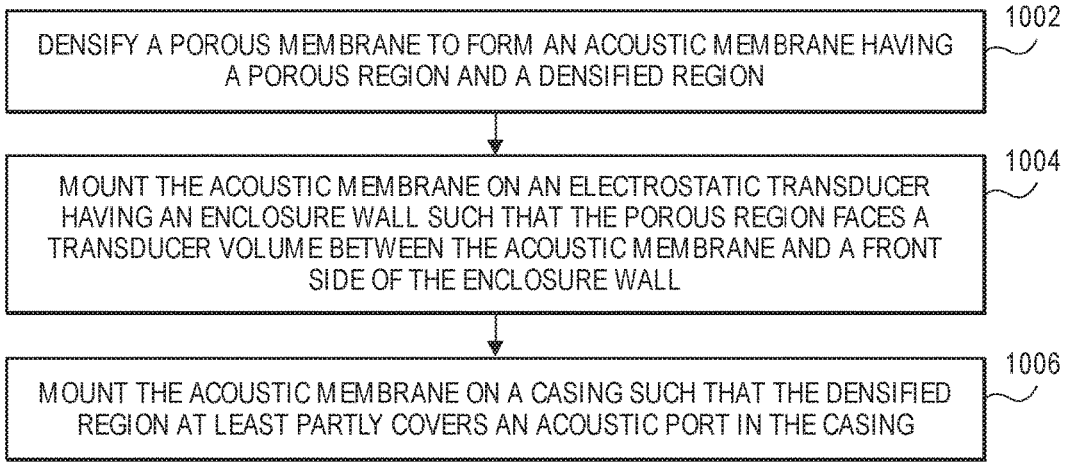
FIG. 10 is a flowchart of a method of making an electronic device having a composite acoustic membrane in accordance with an embodiment.

Referring to FIG. 10, a flowchart of a method of making an electronic device having a composite acoustic membrane is shown in accordance with an embodiment. At operation 1002, a membrane is densified to form acoustic membrane 300. For example, a porous membrane substrate may be modified to create acoustic membrane 300 having one or more porous regions 302 and one or more densified regions, e.g., nonporous regions 304. Thus, the membrane substrate may be altered to not only provide water resistance and venting, but to also provide acoustic characteristics.

Densifying the porous membrane may include deforming the porous membrane in the densified region. For example, the porous membrane substrate may be densified by stretching. The porous membrane substrate may be a material having a predetermined porosity, e.g., an expanded polytetrafluoroethylene (PTFE), and by stretching the material in a transverse direction, the substrate thickness may be reduced in an axial direction. Reduction in thickness may be accompanied by a corresponding decrease in porosity. Thus, localized areas of the porous membrane substrate may be stretched to form one or more nonporous regions 304 in a composite acoustic membrane 300. The porous membrane may be densified by crushing. For example, a die may be used to press a localized area of the porous membrane substrate to crush the porous material and reduce the thickness of the membrane. Accordingly, crushing the porous membrane substrate may form one or more nonporous regions 304 in a composite acoustic membrane 300. Thus, porous membrane may be densified to form an acoustically transparent region, e.g., nonporous region 304.

At operation 1004, acoustic membrane 300 may be mounted on an electroacoustic transducer 506, e.g., microphone 104 or speaker 106. For example, acoustic membrane 300 may be mounted on enclosure wall 514 such that transducer volume 512 is between acoustic membrane 300 and enclosure wall 514. More particularly, electroacoustic transducer 506 may be positioned with respect to acoustic membrane 300 such that porous region 302 faces transducer volume 512. Accordingly, transducer volume 512 between acoustic membrane 300 and a front side of enclosure wall 514 may be placed in fluid communication with surrounding environment 508 or encased space 504 through porous region 302. As such, transducer volume 512 may be vented through porous region 302 of acoustic membrane 300 to surrounding environment 508 or encased space 504.

At operation 1006, acoustic membrane 300 may be mounted on casing 102 such that the densified region, e.g., nonporous region 304, is at least partly covering acoustic port 510 in casing 102. As described above, acoustic membrane 300 may be positioned such that nonporous region 304 entirely covers acoustic port 510. Thus, air permeable channel 404 of porous region 302 may extend between transducer volume 512 and encased space 504 between a back side of enclosure wall 514 and casing 102, and air in transducer volume 512 may be vented through acoustic membrane 300 to encased space 504. Alternatively, acoustic membrane 300 may be positioned such that nonporous region 304 only partly covers acoustic port 510. Thus, air permeable channel 404 of porous region 302 may extend between transducer volume 512 and acoustic port 510, and air in transducer volume may be vented through acoustic membrane 300 to surrounding environment 508 through porous region 302.

It will be appreciated that the operations described above may be performed in a different order. For example, acoustic membrane 300 may be mounted on casing 102 prior to being mounted on electroacoustic transducer 506. When acoustic membrane 300 is mounted on electroacoustic transducer 506 prior to being mounted on casing 102, an electroacoustic transducer component may be manufactured as a subassembly, which may then be assembled to casing 102 during the manufacture of electronic device 100.

The method of making an electronic device 100 having a composite acoustic membrane 300 may include additional operations not represented in the flowchart of FIG. 10. For example, protective barrier 902 may be mounted on spacer 906 in an operation. The spacer 906 may be mounted on acoustic membrane 300 to form protective gap 904 between protective barrier 902 and acoustic membrane 300. Either of operations 1004 or 1006 may be performed such that protective barrier 902 covers acoustic port 510 to protect acoustic membrane 300 within casing 102.

In the foregoing specification, the invention has been described with reference to specific exemplary embodiments thereof. It will be evident that various modifications may be made thereto without departing from the broader spirit and scope of the invention as set forth in the following claims. The specification and drawings are, accordingly, to be regarded in an illustrative sense rather than a restrictive sense.

What is claimed is:

1. An electronic device, comprising:

a casing separating an encased space from a surrounding environment, wherein the casing includes an acoustic port;

an electroacoustic transducer within the encased space, the electroacoustic transducer having an enclosure wall, wherein a transducer volume is between the enclosure wall and the acoustic port; and an acoustic membrane covering the acoustic port, wherein the acoustic membrane includes a nonporous region at least partly covering the acoustic port, wherein the nonporous region is air impermeable, and wherein the nonporous region is acoustically transparent, and a porous region in fluid communication with the transducer volume, wherein the porous region is air permeable, and wherein the porous region is acoustically opaque compared to the nonporous region.

2. The electronic device of claim 1, wherein the nonporous region surrounds the porous region.

3. The electronic device of claim 2, wherein the porous region includes an air permeable channel between the transducer volume and one or more of the acoustic port or the encased space.

4. The electronic device of claim 3, wherein the porous region is symmetrically arranged about an axis of symmetry extending through the acoustic port.

5. The electronic device of claim 1 further comprising a protective barrier covering the acoustic port between the surrounding environment and the acoustic membrane.

6. The electronic device of claim 5 further comprising a spacer between the protective barrier and the acoustic membrane, wherein a protective gap is between the protective barrier and the acoustic membrane.

7. The electronic device of claim 1, wherein the electroacoustic transducer includes a microphone having a diaphragm within the transducer volume.

8. An electroacoustic transducer component, comprising:

an electroacoustic transducer including an enclosure wall; and an acoustic membrane mounted on the enclosure wall, the acoustic membrane including a nonporous region, wherein the nonporous region is air impermeable, and wherein the nonporous region is acoustically transparent, and a porous region, wherein the porous region is air permeable, and wherein the porous region is acoustically opaque compared to the nonporous region;

wherein a transducer volume is between the acoustic membrane and the enclosure wall, and wherein the transducer volume is in fluid communication with a surrounding environment through the porous region.

9. The electroacoustic transducer component of claim 8, wherein the nonporous region surrounds the porous region.

10. The electroacoustic transducer component of claim 9, wherein the porous region is symmetrically arranged about an axis of symmetry orthogonal to a front surface of the acoustic membrane.

11. The electroacoustic transducer component of claim 8 further comprising a protective barrier covering the acoustic membrane.

12. The electroacoustic transducer component of claim 11 further comprising a spacer between the protective barrier and the acoustic membrane, wherein a protective gap is between the protective barrier and the acoustic membrane.

13. The electroacoustic transducer component of claim 8, wherein the electroacoustic transducer includes a microphone having a diaphragm within the transducer volume.

14. A method, comprising:

providing a densified acoustic membrane having a nonporous region and a porous region; wherein the nonporous region is acoustically transparent and the porous region is acoustically opaque compared to the nonporous region;

providing an electroacoustic transducer having an enclosure wall and a transducer volume; and mounting the densified acoustic membrane on the electroacoustic transducer in such a manner that the porous region of the mounted densified membrane faces the transducer volume between the densified acoustic membrane and a front side of the enclosure wall.

15. The method of claim 14 further comprising:

providing a casing; and the mounting comprising mounting the acoustic membrane on the casing, wherein the nonporous region at least partly covers an acoustic port in the casing.

16. The method of claim 15, wherein the porous region includes an air permeable channel positioned between the transducer volume and the acoustic port.

17. The method of claim 15, wherein the porous region includes an air permeable channel positioned between the transducer volume and an encased space between a back side of the enclosure wall and the casing.

18. The method of claim 14, wherein the densified acoustic membrane includes a deformed acoustic membrane.

19. The method of claim 14, wherein the electroacoustic transducer includes a microphone having a diaphragm within the transducer volume.

20. The method of claim 14 further comprising: mounting a protective barrier on a spacer; and mounting the spacer on the densified acoustic membrane to form a protective gap between the protective barrier and the densified acoustic membrane.

21. An electronic device, comprising:

a casing separating an encased space from a surrounding environment, wherein the casing includes an acoustic port;

an electroacoustic transducer within the encased space, the electroacoustic transducer having an enclosure wall, wherein a transducer volume is between the enclosure wall and the acoustic port; and an acoustic membrane covering the acoustic port, wherein the acoustic membrane includes a nonporous region at least partly covering the acoustic port, wherein the nonporous region is air impermeable, and a porous region in fluid communication with the transducer volume, wherein the porous region is air permeable, and wherein the porous region is thicker than the nonporous region.

22. The electronic device of claim 21, wherein the nonporous region surrounds the porous region.

23. The electronic device of claim 21 further comprising a protective barrier covering the acoustic port between the surrounding environment and the acoustic membrane.

24. The electronic device of claim 21, wherein the electroacoustic transducer includes a microphone having a diaphragm within the transducer volume.

* * * * *